US005911875A

United States Patent [19]

Hervish et al.

[11] Patent Number: 5,911,875

[45] Date of Patent: Jun. 15, 1999

[54] METHOD AND SYSTEM FOR GENERATING POWER FROM RESIDUAL FUEL OIL

[75] Inventors: Peter Vernon Hervish, Oviedo; Kermit R. Wescott, Winter Springs; Michael S. Briesch, Orlando; Steve W. Brown, Oviedo, all of Fla.

[73] Assignee: Siemens Westinghouse Power Corporation, Orlando, Fla.

[21] Appl. No.: 08/835,214

[22] Filed: Apr. 7, 1997

[51] Int. Cl.[6] ..... C10C 3/00

[52] U.S. Cl. ..... 208/309; 208/86; 208/321; 48/127.4

[58] Field of Search ..... 208/309, 321, 208/86; 48/127.9

[56] References Cited

U.S. PATENT DOCUMENTS

| | | | |
|---|---|---|---|
| 4,139,453 | 2/1979 | Hutchings | 208/213 |
| 4,193,259 | 3/1980 | Muenger et al. | 60/39.02 |
| 4,199,439 | 4/1980 | Gatsis | 208/215 |
| 4,341,069 | 7/1982 | Bell et al. | 48/215 |
| 4,421,639 | 12/1983 | Lambert et al. . | |
| 4,503,681 | 3/1985 | Willyoung et al. | 60/655 |
| 4,784,753 | 11/1988 | Hotier et al. | 208/309 |
| 4,900,428 | 2/1990 | Mester | 208/121 |
| 4,986,349 | 1/1991 | Ono | 165/154 |
| 5,002,653 | 3/1991 | Kennedy et al. | 208/118 |
| 5,032,253 | 7/1991 | Wang et al. | 208/254 H |
| 5,364,524 | 11/1994 | Partridge et al. | 208/251 H |
| 5,374,350 | 12/1994 | Heck et al. | 208/143 |

FOREIGN PATENT DOCUMENTS

| | | |
|---|---|---|
| 0 757 091 A1 | 2/1997 | European Pat. Off. . |
| 8 400 074 | 12/1983 | Netherlands . |

OTHER PUBLICATIONS

Chung, K.H. et al., "Supercritical fluid extraction reveals resid properties", *Technology,* 1997, 66–69.

*Primary Examiner*—Helane Myers

[57] ABSTRACT

A method of generating power from residual fuel oil that is deasphalted with a flow of process steam to produce a deasphalted oil stream, a pitch stream, and a deasphalting condensate stream. The deasphalted oil stream is burned in a pressurized oxygen-bearing gas to produce a pressurized hot gas stream. This pressurized hot gas stream is expanded in a turbine that produces shaft power and an expanded gas stream. The expanded gas stream is cooled by transferring heat from it to a flow of feed water that becomes steam. A portion of the steam becomes at least part of the flow of process steam used to deasphalt the residual fuel oil, thus integrating the deasphalting and the steam generation.

28 Claims, 3 Drawing Sheets

METHOD AND SYSTEM FOR GENERATING POWER FROM RESIDUAL FUEL OIL

BACKGROUND OF THE INVENTION

The present invention relates to economically viable uses of residual fuel oil. More specifically, the present invention relates to treating vanadium-containing residual fuel oil such that it can be combusted in a gas turbine to generate power without deleterious effects to the gas turbine from the vanadium.

The high efficiency, low capital cost and short lead time of gas turbine-based systems make them particularly attractive to electric utilities as a means for producing electrical power. However, traditionally, gas turbine operation has been limited to expensive, sometimes geographically scarce, fuels—chiefly distillate oil and natural gas. Unfortunately, gas turbine-based systems do not tolerate fuels containing metals, such as vanadium. When vanadium-containing fuels are burned above 650° C. (1200° F.), as is done in gas turbines, the vanadium attacks the metal components of the turbine and shortens their useful life.

One such vanadium-containing fuel is the residual fuel oil ("RFO") that is a by-product—and is often considered a waste by-product—of the crude oil refining process. Traditional approaches involve either blending the RFO into the fuel oil pool, which will lower the fuel quality, treating the RFO, selling at market demand which may be at a significant loss, or disposing of it. The treatments for the RFO are relatively expensive, using such methods as fluidized bed catalytic cracking, residual oil supercritical extraction, supercritical fluid extraction, high pressure hydrocracking, flexicoking, thermal visbreaking, gasification, delayed coking, centrifuging, and applying magnesium-based vanadium inhibitors in the RFO. The untreated RFO has little open market value, and often the refinery must give it away or pay to have it taken.

With more lower quality crude oil being refined than in the past, the amount of RFO being produced is increasing. Often, the third and second world countries choose to sell their refined oil abroad for much needed capital, rather than consume it internally in gas turbines to generate power. This results in fuel existing in these countries in the form of RFO, without an economically viable way to generate power from it.

It is therefore desirable to provide an economical method and system to generate power from the RFO.

SUMMARY OF THE INVENTION

Accordingly, it is the general object of the current invention to provide a method and system for deasphalting the RFO into deasphalted oil and pitch streams that can be burned to generate power and steam. The deasphalting and power/steam generation systems are integrated such that the steam generated by burning the deasphalted oil and pitch is used in the deasphalting step. By integrating these systems, energy from the burning of fuel to generate power that would normally be lost is used in the deasphalting process, leading to greater benefits than if the two systems were operated independently.

Briefly, this object, as well as other objects of the current invention, is accomplished in a method of generating power from residual fuel oil that is deasphalted with a flow of process steam to produce a deasphalted oil stream, a pitch stream, and a deasphalting condensate stream. At least a portion of the deasphalted oil stream is burned in a pressurized oxygen-bearing gas to produce a pressurized hot gas stream. This pressurized hot gas stream is expanded in a turbine that produces shaft power and an expanded gas stream. The expanded gas stream is cooled by transferring heat from it to a flow of feed water that becomes steam. A portion of the steam becomes at least part of the flow of process steam used to deasphalt the RFO, thus integrating the deasphalting and the steam generation.

DESCRIPTION OF THE PREFERRED EMBODIMENT

Figure 1:
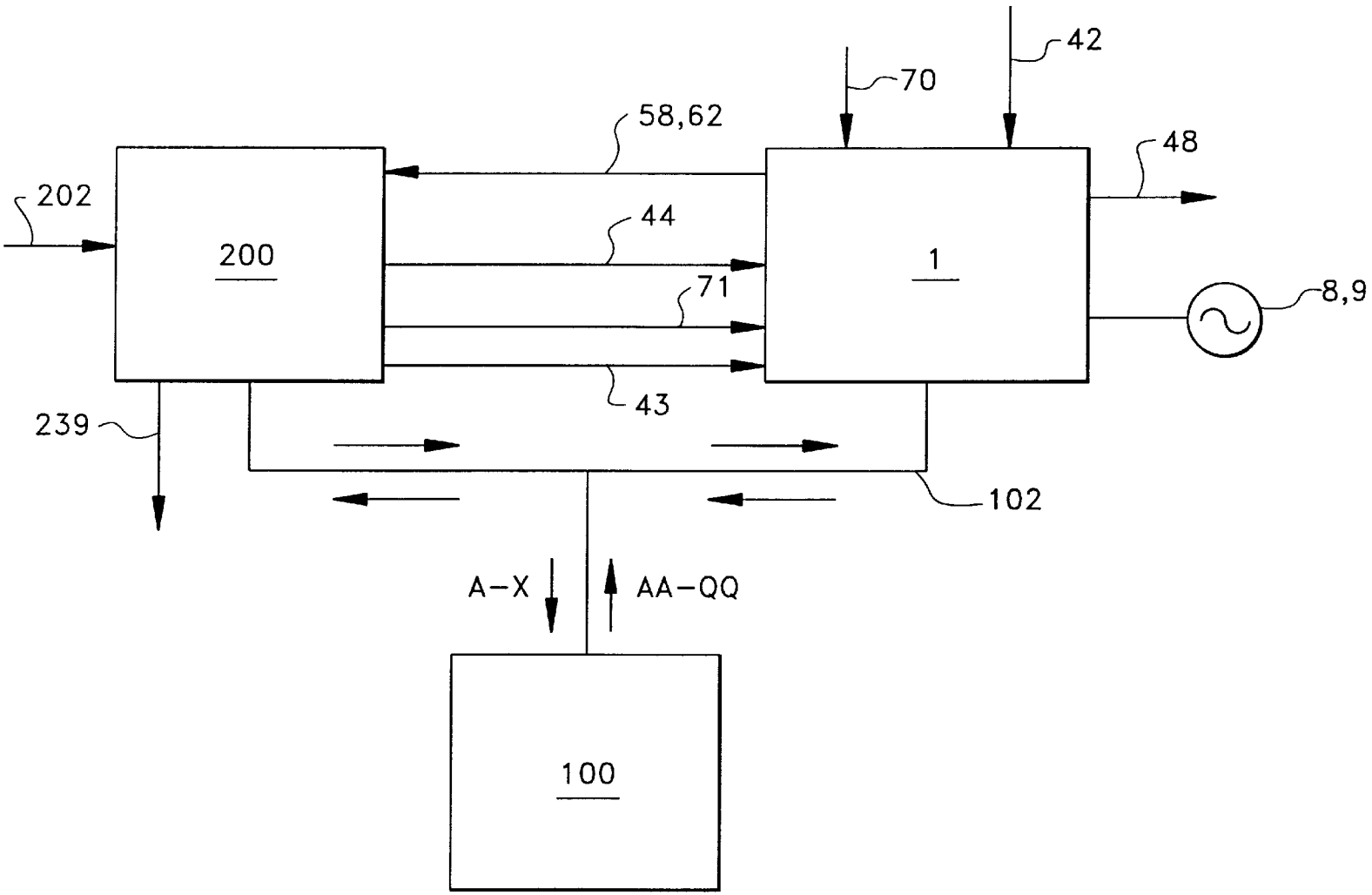
FIG. 1 is a schematic diagram of a power generation and fuel oil treatment plant according to the current invention.

Referring to the drawings, wherein like reference numerals refer to like elements, there is shown in FIG. 1 a schematic of the integration of a deasphalting system 200 with a power and steam generation system 1. The deasphalting system 200 receives residual fuel oil ("RFO") 202, treats it to produce, among other things, deasphalted oil ("DAO") 43 and pitch 44. The DAO 43 and pitch 44 are combusted in the power and steam generation system 1 to produce rotating shaft power that drives electrical generators 8 and 9.

The two systems 1 and 200 are integrated in that they co-supply each other with necessary streams of materials needed to operate, including the DAO 43 and pitch 44 delivered to the power and steam generation system 1. The deasphalting system 200 requires steam and thermal energy to separate the RFO 202 into DAO 43 and pitch 44. The power and steam generating system 1 supplies this need via steam 58 and 62. Additionally, condensate 71 formed from the steam condensing in the deasphalting system 200 is delivered to the power and steam generation system 1 to form an efficient, closed-loop steam system. All of these integrations contribute to the improved thermodynamic efficiency of the overall system compared to operating systems 1 and 200 separately.

These systems are further integrated through a control means 100, which can be a microprocessor based controller, that receives inputs A–X from various components of both systems via transmission means 102. The control means 100 decides operating conditions for both systems based on the inputs A–X, and transmits outputs AA–QQ through the transmission means 102 to other various components of both systems to attain the desired operating conditions. Details of these inputs and outputs are described below.

Figure 2:
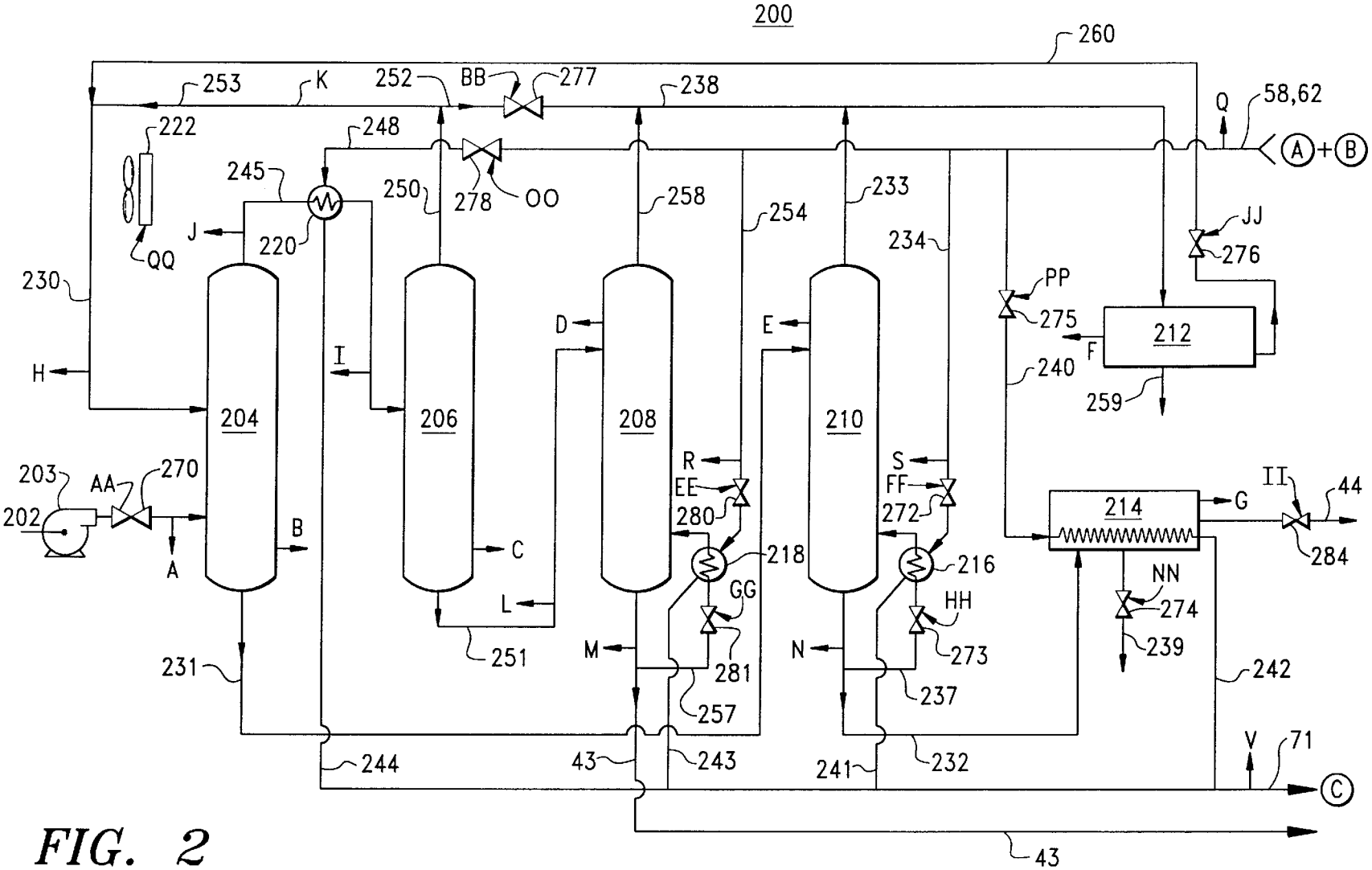
FIG. 2 is a schematic diagram of the fuel oil treatment system shown in FIG. 1.

Now referring to FIG. 2, the deasphalting system 200 of the preferred embodiment of the invention is shown. The deasphalting system 200 is preferably a Residual Oil Supercritical Extraction ("ROSE") deasphalting process that has been modified to use steam as the source of the thermal energy required to treat the RFO stream 202. By treating the RFO 202, it is understood that the deasphalting system 200 separates the RFO 202, having up to 1000 ppm vanadium or more, into the DAO 43 having reduced levels of vanadium and pitch 44 having the bulk of the vanadium. A modified ROSE deasphalting process is available from The M. W. Kellogg Technology Company, 601 Jefferson Ave, Houston, Tex. 77002-7990. Other embodiments of the invention may use other deasphalting processes, such as the Solvahl process available from the Institut Francais du Petrole, Petrole Refining, Petrochemistry, Gas Grad. Center 4, P.B. 311, Avenue de Bois Preau, 92506 Rueil-Malmaison, the LEDA deasphalting process from Foster Wheeler USA Corp., Livingston, N.J., and the supercritical fluid extraction process available through the State Key Laboratory of Heavy Oil Processing at the Petroleum University, Beijing, China, that have been modified to use steam to provide the thermal energy required.

The deasphalting system 200 receives the RFO 202 into a contactor 204. The flow of the RFO 202 is controlled via control valve 270 that is directed by the control means 100 via output AA. A pump 203 pressurizes the RFO 202 to a sufficiently high pressure to feed it into the contactor 204. A feed solvent stream 230 is also fed into the contactor 204. In other embodiments of the invention, a portion of the feed solvent stream 230 is mixed with the RFO 202 prior to it entering the contactor 204. In the preferred embodiment of the invention, the feed solvent is N-butane, but other embodiments of the invention may use other suitable solvents.

A first step to removing the asphaltenes, or "pitch," is performed in the contactor 204. The pitch is much less soluble in the lower specfic gravity solvent than the higher specific gravity raffinate. Therefore, the raffinate flows downward and exits the bottom of the contactor as a raffinate/solvent stream 231. In the preferred embodiment of the invention, slightly less than one volume of entrained solvent per volume of asphaltene exits as part of raffinate/solvent stream 231.

In the next step, the raffinate/solvent stream 231 is directed to a raffinate stripper 210 where the majority of the remaining solvent is stripped from stream 231 using a steam flow 234 to form a raffinate stream 232 and a water-laden solvent stream 233. The steam flow 234 comes from the combined steam flow 58 and 62 that is produced in the power and steam generation system 1. The raffinate stream 232 is directed to a raffinate storage tank 214, except for a portion which forms the raffinate stripper reboiler line 237. The solvent stream 232 is directed to a solvent header 238.

The raffinate/solvent stream 231 enters the top of the raffinate stripper 210 where, in a relatively low pressure environment of less than 100 psig, the solvent flashes off. Another embodiment of the invention may have a preheater on the stream 231 to achieve a minimum feed tray temperature. The pitch component of stream 231 is stripped by steam flow 234 which is directed to a reboiler 216. A condensate stream 241 exits the reboiler 216 and is combined with other condensate lines described below to form condensate 71, that is directed to the power and generation system 1. The volume of steam flow 234 is controlled via control valve 272 that is directed by the control means 100 via output FF. The volume of the pitch stripper reboiler line 237, which provides the thermal energy for the stripper 210, is controlled via control valve 273 that is directed by the control means 100 via output HH. In the embodiment of the invention shown in FIG. 2, some of the inputs that the control means 100 uses to determine its outputs FF and HH are: input E, which transmits the conditions of the pitch stripper 210; input N, which transmits the conditions of the pitch stream 232; and input S, which transmits the conditions of steam flow 234. The term "conditions" shall be understood to mean flow rate, pressure, temperature, volume, level, or any other system measurement that is attained though instrumentation and is relevant for determining outputs of the control means 100. Other embodiments of the invention may use other inputs and have other means to control conditions than what is shown. This statement applies not only to this specific section of this embodiment of the invention, but to other sections of this and other embodiments of the invention as well.

The flow rate of the steam flow 234 is preferably 0.5 to 1.0 lbs/hr of steam per barrels per day of raffinate 44. The steam flow 234 comes from separate intermediate and high pressure steam flows 58 and 62 generated in the power and steam generation system 1 shown in FIG. 3. The steam flow 58 and 62 may be combined in a single steam flow header, as shown in FIG. 2. Other embodiments of the invention may have multiple headers and/or separate headers for each steam flow pressure. An additional embodiment of the invention may have another steam flow going into the raffinate stripper 210 directly, which results in the production of sour water.

The pitch storage tank 214 receives the raffinate stream 232 and keeps it heated to maintain viscosity until it exits the tank. The pitch storage tank is heated by a steam flow 240. The volume of the steam flow 240 regulated by control valve 275, which is controlled by an output signal PP. An input G from the pitch storage tank 214 is transmitted to the control means 100 to determine the volume of steam needed to maintain pitch viscosity. A condensate stream 242 removes the condensate formed from the condensing steam flow 240 and directs it to condensate 71. Pitch exits the tank 214 as pitch streams 44 and 239. Pitch 44 is directed to the power and system generation system 1 to be used as fuel, as is described below. Pitch stream 239 is used for other purposes, such as a component of asphalt cement-bitumen, asphalt emulsions, roofings, coatings, binders, fuel, and chemical feedstocks. The volumes of pitch 44 and pitch stream 239 are controlled by the control means 100 via outputs 11 and NN transmitted to control valves 284 and 274, respectively. In the preferred embodiment of the invention, the control means 100 optimizes the volumes of pitch 44 and pitch stream 239 for economic benefit.

The contactor 204 also produces a solvent/DAO stream 245, which is heated by heater 220 and directed to a DAO separator 206. A steam flow 248 is directed to the heater 220 with the volume of steam being controlled by control means 100 via outputs OO to an in-line control valve 278. A condensate stream 244 from the heater 220 is directed to condensate 71. The heater 220 heats the solvent/DAO stream 245 to above the critical temperature of the pure solvent. Other embodiments of the invention add thermal energy to the stream 245 by other means, including exchanging thermal energy with other streams in the system. The purpose of heating the stream 245 to above the solvent's critical temperature is to decrease the density of the solvent. This results in the DAO component in the solvent/DAO stream 245 being less soluble in the solvent so that phase separation occurs. In the preferred embodiment of the invention, at least 90% of the solvent in the solvent/DAO stream separates out in the DAO separator and exits as solvent stream 250. The remainder exits the DAO separator 206 as bottoms stream 251 and is directed to a DAO stripper 208. In the preferred embodiment of the invention, the bottoms stream 251 contains slightly less than 1 volume of entrained solvent per volume of DAO. The operating conditions of the DAO separator 206 are set to achieve the required density difference needed for good separation.

A portion 253 of the solvent stream 250 is combined with the feed solvent stream 260 to provide recycled solvent to contactor 204, as well as thermal energy. Operating temperature, solvent composition, solvent-to-oil ratio, and, to a lesser extent, pressure in the contactor 204 affect DAO yield and quality. Since certain parameters (i.e., total solvent-to-oil ratio, solvent composition, and operating pressure) are fixed at relatively constant values, the operating temperature of the contactor 204 is used as the primary performance variable. Further, the amount of DOA yielded from the RFO 202 is effectively controlled by the contactor 204 operating temperature. Higher operating temperatures result in less DOA in the solvent/DOA stream 245. Lower operating temperatures produce a solvent/DOA stream 245 with relatively more DOA, but of poorly quality. The conditions of the contactor 204 are transmitted to the control means 100 via input B. The control means 100 controls the temperature in the contactor 204 by controlling the temperature and flow of the solvent feed stream 230. The temperature of stream 230 is raised by the heater 220, which increases the temperature of solvent/steam stream 245 and, therefore, the solvent stream 253. The temperature of the solvent stream 230 is lowered by a cooler 222, which uses ambient air as the cooling medium and which is controlled via output QQ, removing thermal energy from stream 230. The amount, or flow, of stream 230 is controlled via control valves 276 and 277 that are directed by the control means 100 through outputs JJ and BB, respectively. Control valve 276 controls the amount of feed solvent 260 that is sent back to the system from a solvent surge tank system 212. Control valve 277 controls the flow of a solvent stream 252, which is the portion of the stream 250 that does become stream 253, that is directed to the solvent surge tank system 212. By increasing the flow of the stream 252, the flow of stream 253 decreases. To make the necessary determinations, control means 100 receives inputs A, B, C, F, I, J, K, and V. Other embodiments of the invention may use other inputs. Excess solvent in the solvent surge tank system may be removed via the excess solvent line 259.

The DAO stripper 208 strips a majority of the remaining solvent from bottoms stream 251 using a steam flow 254, thereby forming the DAO 43 and a solvent stream 258. The bottoms stream 251 enters the upper portion of the DAO stripper 208. As the pressure in the stripper is less than 100 psig, at least a portion of the solvent in the bottoms stream 251 flashes off and forms the solvent stream 258. The DAO component of the stream is reboiled with steam flow 254 that is directed to a reboiler 218 in a DAO stripper recycle line 257. The volume of steam flow 254 is controlled via control valves 280 that is directed by the control means 100 via output EE. The volume of the DAO stripper reboiler line 257, which provides the thermal energy for the stripper 208, is controlled via control valve 281 that is directed by the control means 100 via output GG. In the embodiment of the invention shown in FIG. 2, some of the inputs that the control means uses to determine its outputs EE, and GG are: input D, which transmits the conditions of the DAO stripper 208; input M, which transmits the conditions of the DAO 43; and input R, which transmits the conditions of steam flows 254. Other embodiments of the invention may use other inputs and have other means to control conditions than what is shown. A condensate stream 243 exits the reboiler 218 and is combined with other condensate lines 244, 241, and 242 to form condensate 71, which is directed to the power and generation system 1.

The steam flow 254 that is directed to the reboiler 218 comes off of the steam 58 and 62. The flow rate of the steam flow 254 is preferably 0.5 to 1.0 lbs/hr of steam per barrels per day of DAO 43. An additional embodiment of the invention may have another steam flow going into the raffinate stripper 210 directly, which results in the production of sour water.

The preferred embodiment of the invention may use a closed looped solvent system, aspects of which were previously disclosed. The function of the system is to provide feed solvent 230 to the contactor 204 for extracting the DAO from the RFO 202 stream. During the deasphalting process, the solvent becomes contaminated with DAO and pitch. Relatively clean solvent occurs in stream 252 discharging from the DAO separator 206. A portion of this, the stream 253, is directed to the contactor 204. The other portion, the stream 252, is combined with the stream 258 from the DAO stripper 208 and the stream 233 from the raffinate stripper 210 to form the solvent header 238. The solvent header 238 is directed to the solvent surge tank system 212. The solvent surge tank system 212 performs other treatment processes as required for a specific embodiment, i.e., purging of non-condensable gases to a treatment system. The solvent surge tank system 212 is sized to accommodate the surges of solvent which accompany the stream 252. This situation occurs primarily during start-up.

Figure 3:
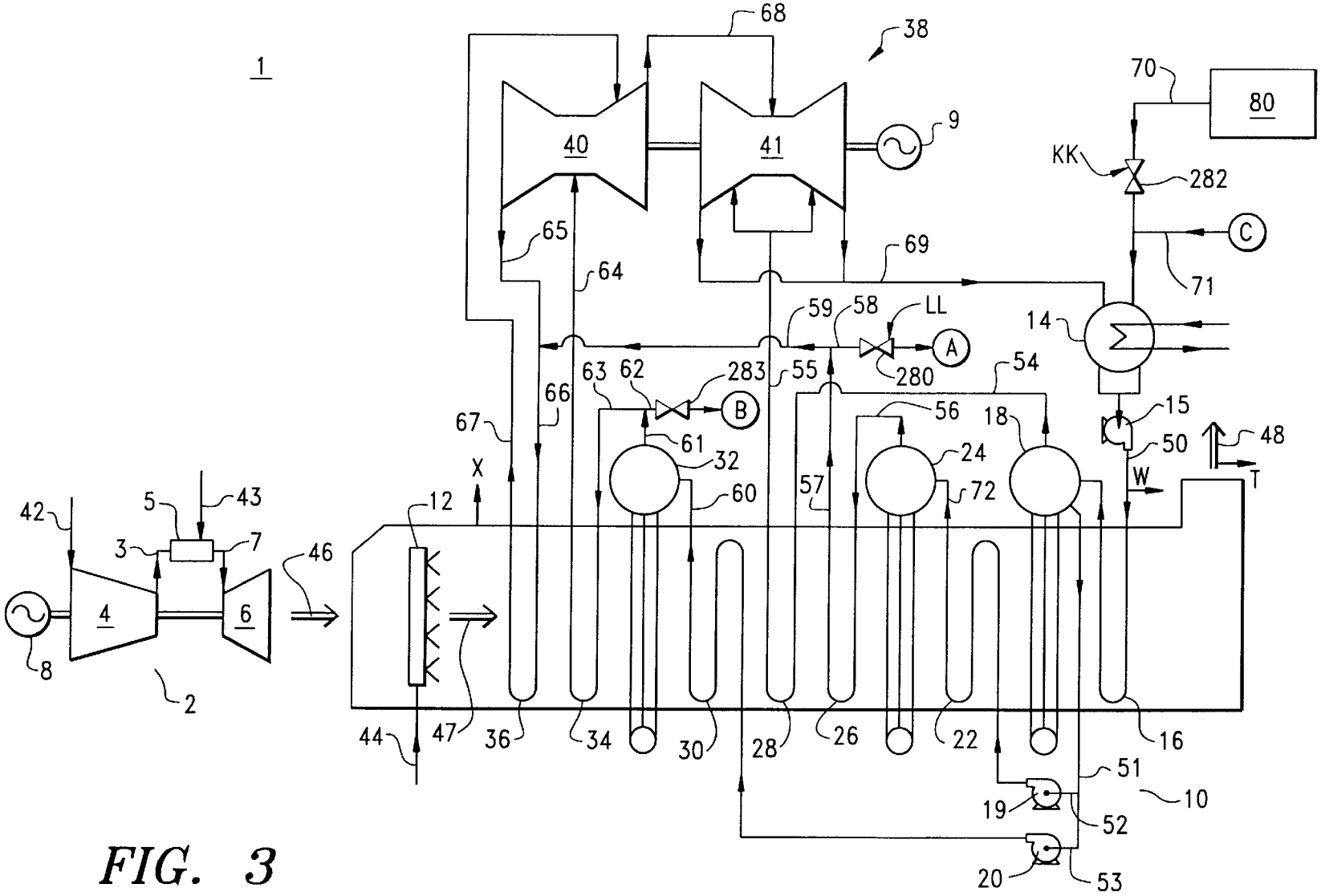
FIG. 3 is a schematic diagram of the power and steam generation system shown in FIG. 1.

The system 1 for generating power and steam from the DAO and pitch produced by the fuel oil treatment system 200 is shown in FIG. 3. The system 1 comprises three major components—a gas turbine 2, a heat recovery steam generator ("HRSG") 10, and a steam turbine 38.

As is conventional, the gas turbine 2 is comprised of a compressor 4, a combustor 5, and a turbine 6.

The HRSG 10 is preferably of the three pressure level type and is comprised of a duct burner 12 and low, intermediate and high pressure sections. The low pressure section is comprised of a low pressure economizer 16, a low pressure evaporator 18, and a low pressure superheater 28. The intermediate pressure section is comprised of an intermediate pressure economizer 22, an intermediate pressure evaporator 24, an intermediate pressure superheater 26, and an intermediate pressure reheater 36. The high pressure section is comprised of a high pressure economizer 30, a high pressure evaporator 32, and a high pressure superheater 34.

The steam turbine 38 is comprised of a high pressure turbine 40, a low pressure turbine 41, an electrical generator 9, and a condenser 14.

In operation, the compressor 4 inducts ambient air 42 and produces compressed air 3, which is directed to the combustor 5. In the combustor 5, the DAO 43 is burned in the compressed air 3 so as to produce a hot gas 7. Since, as previously discussed, the fuel treatment system causes the major portion of the vanadium in the residual fuel oil to remain in the pitch, the DAO 43 preferably has less than 1 PPMW of vanadium. This permits the combustion of sufficient DAO 43 to heat the hot gas 7 to the maximum temperature permitted by the mechanical constraints associated with the turbine components, preferably a temperature in excess of 1100° C. (2000° F.).

The hot gas 7 discharged from the combustor 5 is expanded in the turbine 6, thereby producing rotating shaft power that drives an electrical generator 8, which produces electricity, as well as the compressor rotor. The hot gas 46 discharged from the turbine 6, which in the preferred embodiment is at a temperature of approximately 566° C. (1050° F.), is directed to the HRSG 10. In the HRSG 10, heat is transferred from the hot gas 47 to feed water and steam so as to generate both superheated steam for the steam turbine 38, as well as pre-heating and reboiling steam for the fuel treatment system 200. The cooled exhaust gas 48 is discharged from the HRSG 10 to atmosphere.

In the HRSG 10, pitch 44 from the pitch storage 214 is burned in the duct burner 12, thereby reducing the oxygen level and raising the temperature of the exhaust gas 46. The amount of pitch 44 burned may be maximized to the point where oxygen in the cooled exhaust gas 48 exiting the HRSG 10 is reduced to no more than approximately 6 volume percent. The oxygen level in the exhaust gas 48 is transmitted to the control means 100 via input T. Based on input T, the control means 100 changes the flow of the pitch 44 by transmitting output II to control valve 284, which changes the oxygen level in the gas. The flow of pitch may also be controlled based on the temperature of the gas 47 after the duct burner 12 such that the gas temperature does not go above approximately 650° F. The temperature of the gas 47 is transmitted to control means 100 via by input X. Based on input X, the control means 100 changes the flow of the pitch 44 by transmitting output II to control valve 284, which changes the temperature of gas 47. In the preferred embodiment of the invention, the pitch flow rate is based on the oxygen level in the cooled exhaust gas 48 without regard to the temperature of the expanded gas stream 47.

During operation of the HRSG 10, condensate 50 is directed by pump 15 from the hot well of the condenser 14 to the low pressure economizer 16 where its temperature is raised to slightly below saturation temperature. The heated feed water from the low pressure economizer 16 is then directed to the steam drum of the low pressure evaporator 18, which preferably operates at a pressure of approximately 450 kPa (60 psig). Saturated steam 54 from the low pressure evaporator 18 is directed to a low pressure superheater 28, where its temperature is preferably raised to approximately 316° C. (600° F.). The superheated low pressure steam 55 is directed an intermediate stage in the low pressure steam turbine 41, where it is expanded, thereby producing rotating shaft power to drive the electrical generator 9.

As shown in FIG. 3, a portion 51 of the heated feed water in the steam drum of the low pressure evaporator 18 is extracted from the drum and split into two streams 52 and 53. The first feed water stream 52 is directed to an intermediate pressure boiler feed pump 19, which raises its pressure and directs it to the intermediate pressure economizer 22, where its temperature is heated to slightly below saturation temperature. From the intermediate pressure economizer 22, the heated feed water 72 is directed to the steam drum of the intermediate pressure evaporator 24, which preferably operates at a pressure of approximately 2,760 kPa (400 psig). Intermediate pressure steam 56 from the intermediate pressure evaporator 24 is directed to the intermediate pressure superheater 26, where its temperature is preferably raised to approximately 290° C. (550° F.). The superheated intermediate pressure steam 57 is then split into two streams 58 and 59. The flow rate of the intermediate pressure steam 58 is controlled by the control means 100 via output LL to a control valve 280 in the steam line. The amount of the flow rate is determined by the steam demand of the deasphalting system 200. In the embodiment of the invention shown in FIGS. 2 and 3, the intermediate pressure steam 58 is combined with the high pressure steam 62, as previously discussed. Intermediate pressure steam 59 is combined with intermediate pressure steam discharged from the high pressure steam turbine 40 for further heating, as discussed below.

The second feed water stream 53 from the low pressure evaporator steam drum is directed to a high pressure boiler feed pump 20, which raises its pressure and directs it to the high pressure economizer 30, where its temperature is heated to slightly below saturation temperature. From the high pressure economizer 30, the heated feed water 60 is directed to the steam drum of the high pressure evaporator 32, which preferably operates at a pressure of approximately 11,700 kPa (1700 psig). High pressure saturated steam 61 from the high pressure evaporator 32 is split into two streams 62 and 63. The flow rate of the high pressure steam 62 is controlled by the control means 100 via output MM to a control valve 283 in the steam line. The amount of the flow rate is determined by the steam demand of the deasphalting system 200.

High pressure steam 63 is directed to the high pressure superheater 34, where its temperature is preferably raised to approximately 538° C. (1000° F.). The superheated high pressure steam 64 is directed to the high pressure steam turbine 40, where it is partially expanded, thereby producing additional shaft power to drive the electrical generator 9. The high pressure steam turbine 40 discharges two streams of intermediate pressure steam 65 and 68. Intermediate pressure steam 65 is combined with a portion of the superheated intermediate pressure steam 59 from the intermediate pressure superheater 26, as previously discussed, and then reheated in the reheater 36 to a temperature that is preferably approximately 538° C. (1000° F.). The reheated steam 67 is then directed to an intermediate stage in the high pressure steam turbine 40 for further expansion. Intermediate pressure steam 68 is directed to the low pressure steam turbine 41 to complete the expansion.

Low pressure steam 69 discharged from the low pressure steam turbine 41, which is preferably at sub-atmospheric pressure, is directed to the condenser 14 for return to the system. The condenser 14 is also supplied with deaerated make-up water 70 from a feed water supply 80, along with condensate 71 returned from the deasphalting system 200. The volume of the make-up water 70 is controlled by the control means 100 transmitting output KK to control valve 282. The volume is determined based on input W, the conditions of condensate 50, and input U, the conditions of condensate 71. Other embodiments of the invention may have different inputs or control mechanisms.

As can be readily appreciated, the system described above generates a maximum amount of electrical power in the generators 8 and 9 from the consumption of the DAO 43 and pitch 44 produced by the fuel oil treatment system.

Although the present invention has been discussed with reference to a particular system for generating steam and power, other DAO burning systems could also be utilized. For example, the gas turbine could be operated in a simple cycle mode and the steam required by the fuel oil treatment system could be supplied by an auxiliary boiler burning the pitch or a heat recovery boiler in the simple cycle hot gas path. In addition, all of the steam generated by the HRSG could be directed to the steam turbine and the steam requirements of the fuel oil treatment system provided by extracting intermediate pressure steam from the steam turbine. Consequently, the present invention may be embodied in other specific forms without departing from the spirit or essential attributes thereof and, accordingly, reference should be made to the appended claims, rather than to the foregoing specification, as indicating the scope of the invention.

We claim:

1. A method for separating a vanadium containing residual fuel oil into a substantially vanadium free oil stream and into a vanadium containing pitch stream, and for generating power to fuel the separating process by combustion of at least one of the oil stream and pitch stream, comprising the steps of:

a) deasphalting said residual fuel oil with a flow of process steam, to produce a deasphalted, substantially vanadium free oil stream, the pitch stream, and a deasphalting condensate stream;

b) burning at least a portion of said deasphalted oil stream in a pressurized oxygen-bearing gas so as to produce a pressurized hot gas stream;

c) expanding said pressurized hot gas stream in a first gas turbine so as to produce shaft power and an expanded gas stream;

d) cooling said expanded gas stream by transferring heat from said expanded gas stream to a first flow of feed water, comprising at least a portion of said deasphalting condensate stream, so as to generate a first flow of generated steam, wherein said flow of process steam comprises at least a first portion of said first flow of generated steam; and e) expanding another portion of said generated steam in a steam turbine to produce shaft power.

2. The method according to claim 1, wherein the step of deasphalting further comprises the steps of:

a) heating the feed solvent stream, comprising a solvent, with a first portion of said flow of process steam to produce a heated feed solvent stream and a first condensate stream; and b) contacting said residual fuel oil with said heated feed solvent stream to produce a solvent/deasphalted oil stream and a raffinate/solvent stream.

3. The method according to claim 2, wherein the step of deasphalting further comprises the step of stripping solvent from said raffinate/solvent stream with a second portion of said flow of process steam to produce a raffinate stream, and a second condensate stream.

4. The method according to claim 3, further comprising the step of burning at least a portion of said pitch stream in said expanded gas stream prior to said cooling step.

5. The method according to claim 4, wherein said step of burning said portion of said pitch stream further comprises the steps of:

a) combusting the flow of said portion of said pitch stream in a duct burner in said heat recovery steam generator system;

b) directing said expanded gas stream through said duct burner to produce a heated expanded gas stream; and c) controlling said flow of said portion of said pitch stream such that said heated expanded gas stream temperature is not higher than 650° F.

6. The method according to claim 4, wherein said step of burning said portion of said pitch stream further comprises the steps of:

a) directing said expanded gas stream through a heat recovery steam generator system to remove heat therefrom and produce a heat recovery steam generator exhaust gas stream;

b) combusting the flow of said portion of said pitch stream in a duct burner in said heat recovery steam generator system; and c) controlling said flow of said portion of said pitch stream such that said heat recovery steam generator exhaust gas stream is approximately 6 volume percent oxygen or higher.

7. The method according to claim 6, wherein the step of heating said feed solvent stream further comprises the steps of:

a) heating said solvent/deasphalted oil stream with said first portion of said flow of process steam to above the critical temperature of said solvent to produce a heated solvent/deasphalted oil stream; and b) separating said heated solvent/deasphalted oil stream by lowering the pressure thereof to flash off a portion of said solvent therein and to form at least a portion of said feed solvent stream and a prestripped deasphalting oil stream.

8. The method according to claim 7, wherein the deasphalting step further comprises the step of stripping solvent from said prestripped deasphalted oil stream with a third portion of said flow of process steam to produce said deasphalted oil stream and a third condensate stream.

9. The method according to claim 8, further comprising the steps of:

a) storing said raffinate stream in a pitch storage tank;

b) directing said portion of said pitch stream out of said pitch storage tank prior to the step of burning said portion of the pitch stream; and c) heating said pitch storage tank with a fourth flow of process steam to produce a fourth condensate stream.

10. The method according to claim 9, further comprising the step of combining said first, second, third, and fourth condensate streams to form said deasphalting condensate stream.

11. The method according to claim 10, wherein the step of cooling said expanded gas stream further comprises the step of transferring heat from said expanded gas to a second flow of feed water so as to generate a second flow of generated steam, wherein said flow of process steam comprises at least a first portion of said second flow of generated steam.

12. The method according to claim 11, wherein said first and second flows of generated steam are generated at first and second pressures, respectively.

13. The method according to claim 12, wherein said second pressure is higher than said first pressure.

14. The method according to claim 13, further comprising the step of expanding a second portion of said first flow of generated steam and a second portion of said second flow of generated steam in a steam turbine means so as to produce shaft power and a flow of expanded steam.

15. The method according to claim 14, further comprising the step of forming at least a portion of said first flow of feed water and at least a portion of said second flow of feed water from said flow of expanded steam and said deasphalting condensate stream.

16. A method for separating a vanadium containing residual fuel oil into a substantially vanadium free oil stream and into a vanadium containing pitch stream, and for generating power to fuel the separating process by combustion of at least one of the oil stream and pitch stream, comprising the steps of:

a) heating said residual fuel oil by transferring heat from a flow of heating steam to said residual fuel oil;

b) separating said heated residual fuel oil into deasphalted oil and pitch;

c) burning at least a portion of said deasphalted oil in a pressurized oxygen bearing gas so as to produce a pressurized hot gas;

d) expanding said pressurized hot gas in a first turbine so as to produce shaft power and an expanded gas; and e) cooling said expanded gas by transferring heat from said expanded gas to a flow of feed water so as to generate a flow of generated steam, at least a portion of said flow of generated steam forming said flow of heating steam used to heat said residual fuel oil and applying another portion of said flow of generated steam to power a steam turbine.

17. The method according to claim 16 further comprising the step of burning at least a portion of said pitch separated from said heated residual fuel oil in said expanded gas prior to transferring heat from said expanded gas to said feed water.

18. A power generation system using a vanadium containing residual fuel oil which has been separated into a substantially vanadium free oil stream and into a vanadium containing combustible pitch stream, and in which the system generates power to fuel the separating process by combustion of at least one of the oil stream and pitch stream, comprising:

a) deasphalting means for deasphalting a residual fuel oil stream with a flow of process steam to produce a deasphalted oil stream, a pitch stream, and a deasphalting condensate stream therefrom;

b) gas turbine means for receiving said deasphalted oil stream and producing a turbine exhaust stream and shaft power therefrom;

c) steam generation means for receiving said turbine exhaust stream and a feed water stream, and producing a flow of generated steam therefrom, wherein said flow of process steam comprises at least a first portion of said flow of generated steam; and d) control means connected to said deasphalting means and said steam generation means for receiving inputs of conditions therein, determining new conditions therein based on said conditions, and transmitting outputs for directing said deasphalting means and said steam generation means to attain said new conditions.

19. The system according to claim 18, wherein said steam generation means comprises means for burning said pitch stream therein to increase the temperature of said turbine exhaust stream.

20. The system according to claim 18, wherein said steam generation means further comprises means for combining said deasphalting condensate stream with said feed water stream.

21. The system according to claim 18, wherein said steam generation means further comprises steam turbine means for receiving a second portion of said flow of generated steam, producing shaft power and steam turbine condensate therefrom, and combining said steam turbine condensate with said feed water stream.

22. A method of treating residual fuel oil having a vanadium content to produce a combustible oil which is substantially vanadium free, comprising the steps of:

a) deasphalting said residual fuel oil with a flow of process steam, to produce a deasphalted oil stream, a pitch stream, and a deasphalting condensate stream wherein the vanadium content attaches to said pitch stream and said oil stream is substantially vanadium free; and b) combusting said pitch stream in a boiler to generate a flow of generated steam from at least a portion of said deasphalting condensate stream, wherein said flow of process steam comprises at least a portion of said flow of generated steam.

23. The method according to claim 22, wherein the step of deasphalting further comprises the steps of:

a) heating a feed solvent stream, comprising a solvent, with a first portion of said flow of process steam to produce a heated feed solvent stream and a first condensate stream; and b) contacting said residual fuel oil with said heated feed solvent stream to produce a solvent/deasphalted oil stream and a raffinate/solvent stream.

24. The method according to claim 23, wherein the step of deasphalting further comprises the step of stripping solvent from said pitch/solvent stream with a second portion of said flow of process steam to produce a raffinate stream and a second condensate stream.

25. The method according to claim 24, wherein the step of heating said feed solvent stream further comprises the steps of:

a) heating said solvent/deasphalted oil stream with said first portion of said flow of process steam to above the critical temperature of said solvent to produce a heated solvent/deasphalted oil stream; and b) separating said heated solvent/deasphalted oil stream by lowering the pressure thereof to flash off a portion of said solvent therein and to form at least a portion of said feed solvent stream and a prestripped deasphalting oil stream.

26. The method according to claim 25, wherein the deasphalting step further comprises the step of stripping solvent from said prestripped deasphalted oil stream with a third portion of said flow of process steam to produce said deasphalted oil stream, and a third condensate stream.

27. The method according to claim 26, further comprising the steps of:

a) storing said raffinate stream in a pitch storage tank;

b) directing said pitch stream out of said pitch storage tank prior to the step of burning said portion of the pitch stream; and c) heating said pitch storage tank with a fourth flow of process steam to produce a fourth condensate stream.

28. The method according to claim 27, further comprising the step of combining said first, second, third, and fourth condensate streams to form said deasphalting condensate stream.

* * * * *